US007695262B2

(12) United States Patent
Refenius et al.

(10) Patent No.: US 7,695,262 B2
(45) Date of Patent: Apr. 13, 2010

(54) PUMP HAVING TOOTHING ON THE ROTARY AND DRIVE SHAFT

(75) Inventors: Viktor Refenius, Wetzlar (DE); Hans Juergen Lauth, Neu-Anspach (DE); Bernd Schneider, Neu-Anspach (DE); Bernd Gebhard, Usingen (DE)

(73) Assignee: Ixetic Bad Homburg GmbH, Bad Homburg (DE)

( * ) Notice: Subject to any disclaimer, the term of this patent is extended or adjusted under 35 U.S.C. 154(b) by 507 days.

(21) Appl. No.: 11/579,647

(22) PCT Filed: Apr. 30, 2005

(86) PCT No.: PCT/DE2005/000800

§ 371 (c)(1),
(2), (4) Date: Nov. 6, 2006

(87) PCT Pub. No.: WO2005/108791

PCT Pub. Date: Nov. 17, 2005

(65) Prior Publication Data

US 2008/0260563 A1 Oct. 23, 2008

(30) Foreign Application Priority Data

May 7, 2004 (DE) ..... 10 2004 022 670

(51) Int. Cl.
*F03C 2/00* (2006.01)
*F03C 4/00* (2006.01)
*F04C 2/00* (2006.01)

(52) U.S. Cl. ..... 418/259; 418/182; 418/268; 403/359.6; 403/350; 464/179

(58) Field of Classification Search ..... 418/166, 418/171, 61.3, 182, 259; 464/162, 179; 403/350, 403/359.6
See application file for complete search history.

(56) References Cited

U.S. PATENT DOCUMENTS 2,182,072 A * 12/1939 Czarnecki ..... 418/225

(Continued)

FOREIGN PATENT DOCUMENTS

| | | |
|---|---|---|
| DE | 1 063 036 | 8/1959 |
| DE | 100 11 065 | 9/2001 |
| DE | 100 53 938 | 5/2002 |
| EP | 0 458 449 | 11/1991 |

OTHER PUBLICATIONS

DIN5480 (German Industrial Standard), Deutsches Institut für Normung e. V. (See e.g. WN2 Software for Involute Spines acc. DIN 5480, Hexagon Software, Berlin, available at http://www.hexagon.de/wn2_e.htm, last accessed Nov. 6, 2006; and Module-DIN 5480 Flat Root Involute Spines, Omni Gear and Machine Corp. reprinted from Ash Gear & Supply, available at http://www.omnigearandmachine.com/DIN5480-involute_splines.htm, last accessed Nov. 6, 2006.

(Continued)

*Primary Examiner*—Theresa Trieu
(74) *Attorney, Agent, or Firm*—Davidson, Davidson & Kappel, LLC

(57) ABSTRACT

A pump, in particular a sliding-vane pump, a roller cell pump, or a gear pump includes a rotating assembly, with, amongst other things, a rotor with radially-sliding vanes, rollers or gears and a drive shaft is provided. The rotor or a gearwheel is connected to the drive shaft by a toothing on the drive shaft and on the rotor or gearwheel for rotational drive.

11 Claims, 3 Drawing Sheets

U.S. PATENT DOCUMENTS 2,389,728 A * 11/1945 Hill ..... 418/166
2,989,951 A * 6/1961 Charlson ..... 418/171
3,247,803 A * 4/1966 Halsey ..... 418/225
3,288,078 A * 11/1966 Monroe et al. ..... 418/61.3
4,231,727 A 11/1980 Buchholz et al.
4,424,013 A * 1/1984 Bauman ..... 418/61.3
4,827,800 A * 5/1989 Pedersen et al. ..... 418/61.3
5,083,909 A * 1/1992 Kunsemiller et al. ..... 418/102
6,932,587 B2 * 8/2005 Dong ..... 418/61.3

OTHER PUBLICATIONS

DIN 5463 (German Industrial Standard), Deutsches Institut für Normung e. V. (See e.g. Metric Paralles Spline Shaft Connections DIN 5463, Omni Gear and Machine Corp., available at http://www.omnigear.us/parellel_splines-DIN5463-pfv.htm, last accessed Nov. 6, 2006.

* cited by examiner

PUMP HAVING TOOTHING ON THE ROTARY AND DRIVE SHAFT

BACKGROUND

The present invention relates to a pump, in particular to a vane-type pump, roller-cell pump, or gear pump, having a rotary assembly, which includes, inter alia, a rotor having radially displaceable vanes or rollers, or gear wheels, and having a drive shaft, the drive shaft and the rotor, respectively a gear wheel, being interlinked by a toothing on the drive shaft and on the rotor, respectively on the gear wheel, for purposes of rotational entrainment.

Pumps of this kind are generally known. In this context, the pumps have toothed-shaft connections having involute flanks according to DIN 5480 or spline-shaft connections having straight flanks according to DIN 5463. Neither type of connection exhibits axial convexity on the toothing, so that it is not possible to compensate for any skewed position among the drive partners. Moreover, due to the minimal clearance between the tooth flanks, torsional shocks from the drive shaft are transmitted, undamped, to the drive partners, thereby promoting wear on the drive partners.

SUMMARY OF THE INVENTION

An object of the present invention is to devise a pump which will overcome these disadvantages.

This objective is achieved by a pump, in particular a vane-type pump, roller-cell pump, or gear pump, having a rotary assembly, which includes, inter alia, a rotor having radially displaceable vanes or rollers, or gear wheels, and having a drive shaft, the drive shaft and the rotor, respectively a gear wheel, being interlinked by a toothing on the drive shaft and on the rotor, for purposes of rotational entrainment, the toothing being designed in accordance with the present invention to be axially convex and radially externally centered.

The external centering has the advantage of making it possible to brace against transversal forces. In the case of two-stroke vane pumps, the external centering provides for a better centering.

A pump is preferred in which the toothing, in addition, exhibits a circumferential clearance among the tooth flanks. It is a distinguishing feature of a pump according to the present invention that the circumferential clearance encompasses an angular region of 3° to 12°, preferably of 6°.

A pump is also preferred in which the toothing, in addition, is able to be acted upon by a transversal force.

It is a distinguishing feature of a pump according to the present invention that the transversal force acting on the external centering surfaces produces tangential frictional forces between the drive shaft and the rotor, and respectively the gear wheel. This has the advantage of enabling torsional shocks to be damped, due to the circumferential clearance and the frictional forces. A pump is also preferred in which the tooth flanks of the toothing have the form of an involute toothing. A pump is also preferred in which the flanks may have a convex design in the axial direction.

It is a distinguishing feature of a pump according to the present invention that the teeth of the shaft are designed to be wider than the teeth of the rotor or of the gear wheel. As a result, the teeth of the shaft, which are required to absorb the transversal force and produce the moment of friction, are advantageously able to have high enough strength for this purpose. A pump is also preferred in which the teeth of the shaft are more than twice as wide as the teeth of the rotor or of the gear wheel.

BRIEF DESCRIPTION OF THE DRAWING

The pump is now described with reference to the figures, which show.

DETAILED DESCRIPTION

Figure 1:
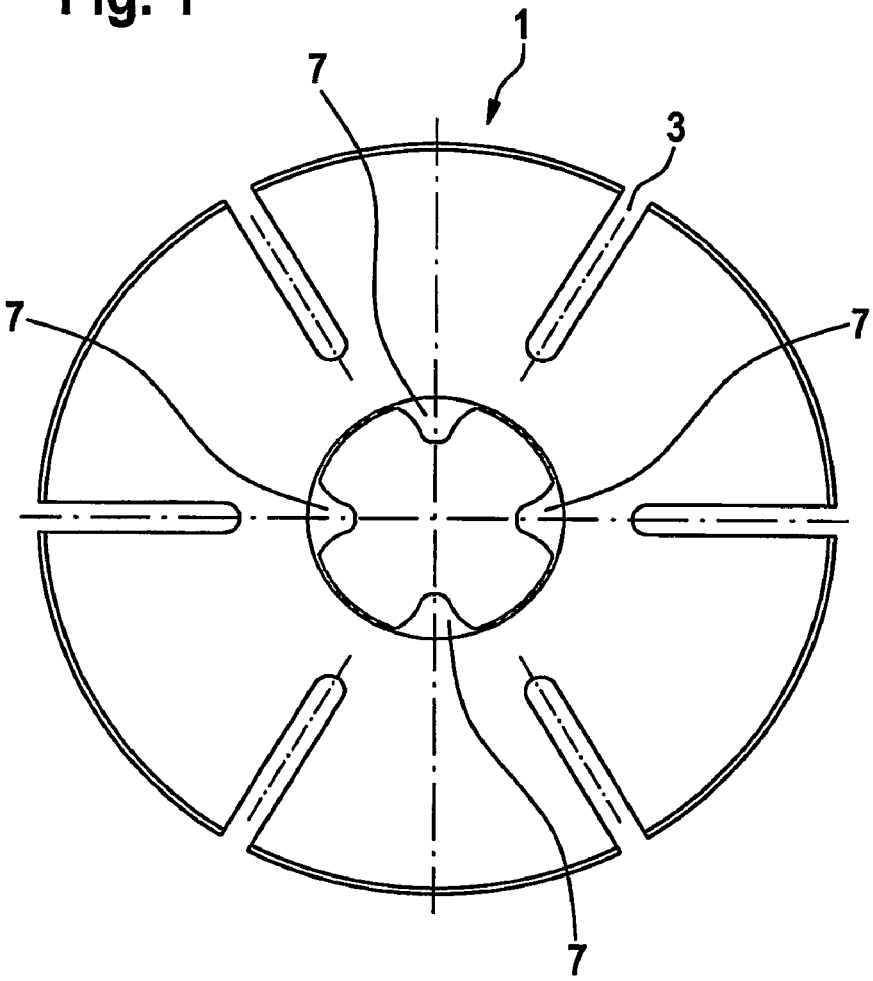
FIG. 1 a plan view of a rotor having a toothing according to the present invention.

A rotor 1 of a six-vane vane pump having an internal toothing according to the present invention is shown in FIG. 1. The rotor includes six slots 3 in which vanes (not shown here) are mounted radially displaceably, and which glide, by their vane tips, along a corresponding lifting ring contour of the vane-type pump. At its center, the rotor includes a toothing having four teeth 7, which are shown, inwardly from the rotor, having a chamfer.

Figure 2:
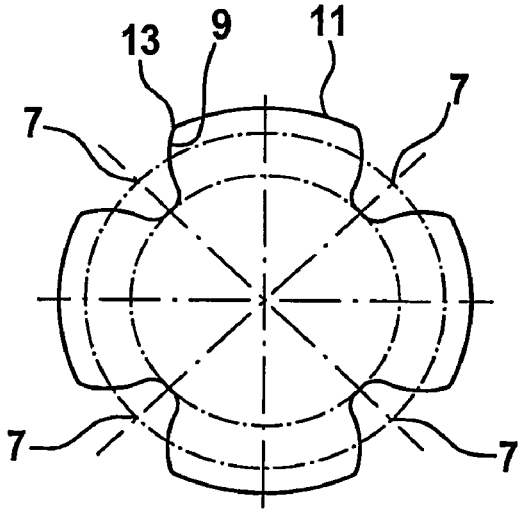
FIG. 2 an enlarged detail of the rotor toothing.

In FIG. 2, the rotor toothing is shown in an enlarged detail. The four teeth 7 have flanks 9, which, in their form, are designed as involute toothing. Tooth roots 13 lead into a root-circle diameter 11, which is used as an external centering circle between the rotor toothing and the shaft toothing.

Figure 3:
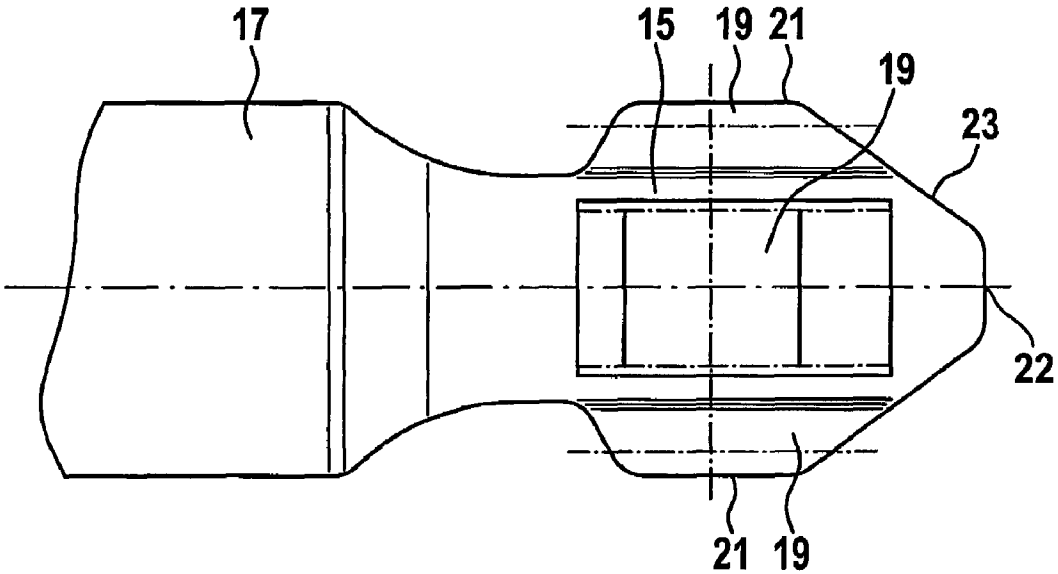
FIG. 3 an end of a drive shaft having the toothing according to the present invention.

FIG. 3 shows toothed end 15 of a drive shaft 17. Toothed shaft end 15 has four teeth 19, which, axially, have a slightly convex design at tooth tips 21 thereof, which is not readily discernible in the representation. Shaft end 15 terminates in a centering and mounting tip 22, thereby facilitating mounting of the shaft in the rotor. As is more readily discernible in FIG. 4, teeth 19 have a correspondingly large width.

Figure 4:
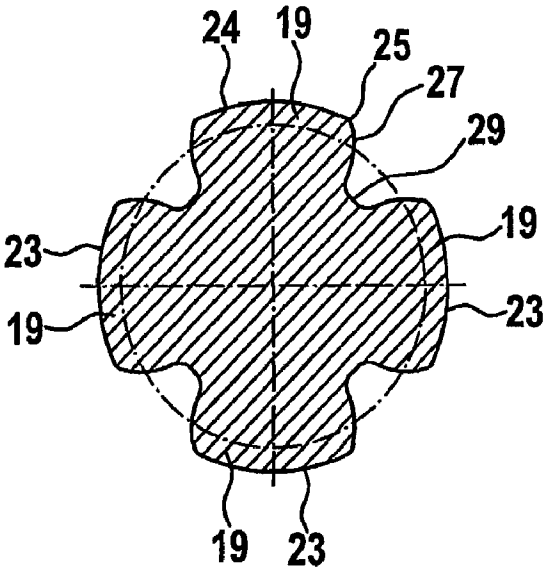
FIG. 4 an enlarged detail of the toothing of the drive shaft, in cross section.

In FIG. 4, the toothing of the shaft is shown in cross section. The four teeth 19 have a relatively large width, including a tooth tip surface 24, this surface representing a circular outside diameter which provides for the centering of the rotor on the shaft. At points 25, circular outside diameter 23 of shaft toothing merges transitionally into an involute tooth flank 27, which then merges transitionally into a root circle 29 of the toothing. It is clearly discernible that the width of shaft teeth 19 is substantially greater than the width of rotor teeth 7. This is deliberately intended in accordance with the present invention since, considered in terms of strength, the shaft toothing must both absorb the transversal forces acting on the rotor, as well as introduce the driving torque from the shaft into the rotor. This requires that the shaft, in particular the shaft toothing, have a suitable material cross section. In this regard, it is precisely the absorption of transversal forces that is problematic for known toothings.

Figure 5:
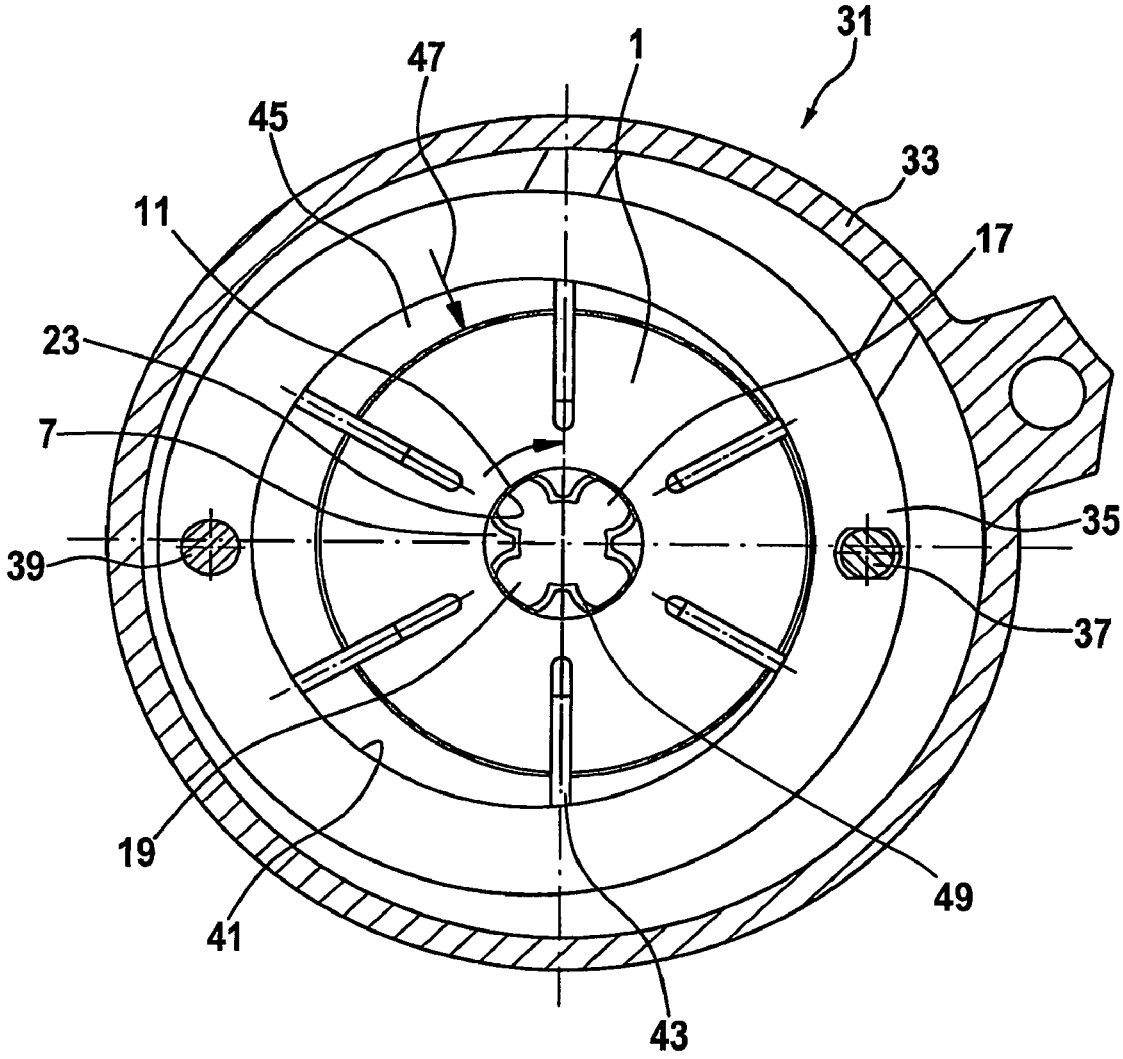
FIG. 5 a plan view of the assembly of a vane-type pump including the toothing according to the present invention between the drive shaft and the rotor.

FIG. 5 shows the assembly of a corresponding vane-type pump 31. Supported within a pump housing 33 is a lifting contour ring 35, which is mounted within the housing by a pin 39 in a round bore and by another pin 37 in a slotted bore. Lifting contour ring 35 has a lifting contour 41 which, in this case, is circular; in other cases, for example when working with two-stroke vane pumps, it may also have any given other contour. Six vanes 43, which are mounted radially slidingly in the slots of rotor 1, glide with their vane tips along lifting contour 41 and thereby form suction and positive-displacement chambers. The function of a vane-type pump of this kind is known and does not require any further explanation here.

Important for the function of the pump in this case is that, due to the position of its pressurized cell, for example cell 45, as a single-stroke vane pump, the pump produces a radial force 47, shown here by an arrow, which acts upon the rotor and is transmitted by the rotor toothing to the shaft and must be absorbed by shaft 17. In the process, the radial force is transmitted via circular toothing surface 11 of the rotor to circular toothing surface 24 of the shaft, these two parts of the toothing form representing an external-diameter centering on the shaft.

Another feature of the toothing according to the present invention is that, between teeth 7 of the rotor and teeth 19 of the shaft, a clearance 49 results, which may include an angular region of 3° to 12°, preferably of 6°. The advantage of this clearance is that, when working with minor torsional shocks of the shaft within this clearance region, the torsional shocks are not transmitted to the rotor in a manner that produces positive engagement. The frictional forces occurring between outside diameter 23 of shaft toothing 19 and inside diameter 11 of rotor toothing 7 act in this context as damping forces between the two motions of the rotor and shaft.

The approach in accordance with the present invention with regard to this toothing thus provides for combining the advantages of an outside diameter-centered spline shaft connection, of a toothed-shaft connection including involute flanks, of axial convexity of the toothing for preventing angular errors between the rotor and shaft, and of an increased clearance among the tooth flanks. The present invention is especially useful for those pumps which are subject to torsional vibrations due to their mounting location, such as diesel presupply pumps, where the diesel motor produces such vibrations at the drive shaft. The axial convexity of the toothing compensates for any possible skewed position of the rotor relative to the drive shaft which is secured, for example, to a camshaft of the combustion engine. The outside-diameter centering of the toothing on the shaft braces against the transversal forces during operation. This prevents a relative motion of the drive partners along the toothing flanks and thus reduces the wear that the toothing is subject to compared to a conventional toothing. At the same time, the friction present at the outside-diameter centering of the toothing of the drive partners is used for damping of the torsional vibrations. The increased clearance among the tooth flanks permits rotation of the drive partners relative to one another, as well as damping of the effects of the torsional vibrations, due to the friction present at the outside-diameter centering. As a result, contact shocks at the tooth flanks are minimized or eliminated due to torsional vibrations, thereby minimizing wear.

The present invention may be used analogously for other pumps as well, such as for gear pumps, for example, where the torque entrainment between the drive shaft and the gear wheel driven by the shaft is also subject to the action of corresponding transversal forces. However, this toothing is likewise advantageous for pumps that are not subject to transversal forces, such as two-stroke vane pumps, since the outside-diameter centering of the shaft toothing and the inside-diameter centering of the rotor provide for a better centering of the shaft than do known toothings. In this case as well, any possible skewed position of the rotor relative to the shaft is able to be compensated by the axial convexity of this toothing according to the present invention.

LIST OF REFERENCE NUMERALS

1 rotor
3 slot
7 teeth of the rotor toothing
9 tooth flanks of the rotor toothing
11 root-circle diameter of the rotor toothing
13 tooth root of the rotor toothing
15 toothed end of the drive shaft
17 drive shaft
19 teeth of the drive shaft
21 tooth tips of the drive shaft
22 mounting tip of the drive shaft
23 outside diameter of the shaft toothing
24 tooth-tip surface of the drive shaft
25 transition of the shaft toothing into the involute tooth flank
27 involute tooth flank of the shaft toothing
29 root circle of the shaft toothing
31 vane-type pump
33 pump housing
35 lifting contour ring
37 pin for lifting contour ring
39 pin for lifting contour ring
41 lifting contour of the lifting contour ring
43 vane
45 cell of the vane-type pump
47 radial force acting on the rotor
49 clearance between the rotor toothing and the shaft toothing

What is claimed is:

1. A pump comprising:

a rotary assembly including a rotor having slots adapted to receive radially displaceable vanes; and a drive shaft, the drive shaft and the rotor being interlinked by respective toothing on the drive shaft and on the rotor, for rotational entrainment, the toothing being designed to be axially convex and radially externally centered.

2. The pump as recited in claim 1 wherein the toothing exhibits a circumferential clearance among tooth flanks of the toothing.

3. The pump as recited in claim 2 wherein the circumferential clearance encompasses an angular region of between 3° and 12°.

4. The pump as recited in claim 1 wherein the toothing is actable upon by a transversal force.

5. The pump as recited in claim 4 wherein the toothing includes external centering surfaces such that a transversal force acting on the external centering surfaces produces tangential frictional forces between the drive shaft and the rotor.

6. The pump as recited in claim 1 wherein the toothing comprises tooth flanks having a form of an involute toothing.

7. The pump as recited in claim 1 wherein the toothing comprises tooth flanks having a convex design in an axial direction.

8. The pump as recited in claim 1 wherein teeth of the drive shaft are designed to be wider than teeth of the rotor.

9. The pump as recited in claim 8 wherein teeth of the drive shaft are designed to be more than twice as wide as teeth of the rotor.

10. The pump as recited in claim 1 wherein the pump is a vane-type pump.

11. A pump comprising:

a rotary assembly including a rotor having slots adapted to receive radially displaceable vanes; and a drive shaft, the drive shaft and the rotor being interlinked by respective toothing on the drive shaft and on the rotor, for rotational entrainment, the toothing being designed to be axially convex and radially externally centered, wherein the toothing exhibits a circumferential clearance among tooth flanks of the toothing, wherein the circumferential clearance encompasses an angular region of about 6°.

* * * * *